United States Patent [19]

Pietryka

[11] 4,022,267

[45] May 10, 1977

[54] CONTINUOUS CASTING INSTALLATION

[75] Inventor: Joseph Pietryka, Paris, France

[73] Assignee: Fives-Cail Babcock, Paris, France

[22] Filed: June 28, 1976

[21] Appl. No.: 700,086

[30] Foreign Application Priority Data

July 2, 1975 France ..... 75.20723

[52] U.S. Cl. ..... 164/260; 164/282

[51] Int. Cl.[2] ..... B22D 11/12

[58] Field of Search ..... 164/82, 282, 283 S, 164/260

[56] References Cited

UNITED STATES PATENTS

| | | | |
|---|---|---|---|
| 3,627,026 | 12/1971 | Bohne | 164/282 |
| 3,779,303 | 12/1973 | Pietryka | 164/282 |

FOREIGN PATENTS OR APPLICATIONS

| | | | |
|---|---|---|---|
| 1,950,772 | 7/1972 | Germany | 164/82 |

*Primary Examiner*—Robert D. Baldwin
*Attorney, Agent, or Firm*—Kurt Kelman

[57] ABSTRACT

The curved roll rack receiving partly solidified metal from the mold in an operating continuous casting installation and defining a path guiding the stream of metal from a substantially vertical into a substantially horizontal direction of movement has two sections consecutively arranged along the path. Pivots secure respective, contiguously adjacent, terminal portions of the sections to a common support for angular movement about horizontal axes while bearings interposed between the remote terminal portions of the two sections permit sliding movement of the remote portions on the support in planes parallel to the associated horizontal axes when the rack thermally expands and contracts.

3 Claims, 1 Drawing Figure

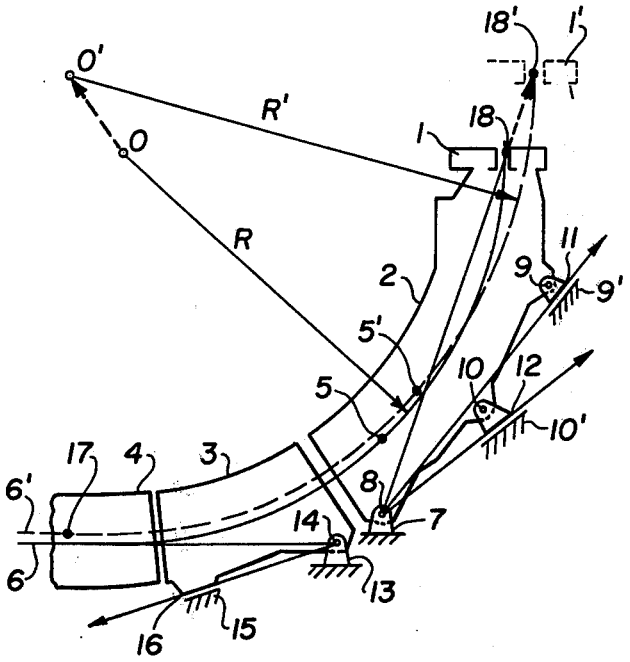
18'
1'
0'
R'
18
1
0
R
11
9
9'
2
5'
10
12
5
10'
17
4
3
6'
8
7
14
6
13
16
15

CONTINUOUS CASTING INSTALLATION

This invention relates to continuous casting installations and particularly to improvements in the curved roll rack of such a installation which guidingly received the partly solidified metal from the mold of the casting installation.

It is known to make the curved roll rack of two sections which are juxtaposed end-to-end between the mold and a set of withdrawing rolls. It is also known to attach the upper section of such a curved rack to the mold and the devices which cause oscillating movement of the mold during casting operation. Such an installation has been disclosed in French Pat. No. 2,121,389. According to the patent, the lower rack section is supported on a pivot and on a slide which permit free thermal expansion of the lower section.

Because the two rack sections in such an installation expand independently from each other, the flow path of the cast metal, which is defined by the arcuate median lines of the two rack sections may have a point of angular discontinuity at certain temperatures within the operating range of the apparatus. This relatively abrupt change in the direction of metal movement at this point has been found to impair the quality of the casting.

It is the primary object of this invention to avoid this shortcoming of the known apparatus, and to mount each section of the roll rack on a support in such a manner that the path of metal movement follows a continuous arc regardless of thermal changes in the dimensions of the individual rack sections.

With this object and others in view, as will hereinafter become apparent, the invention provides an improvement in a continuous casting installation including an oscillating mold downwardly discharging a stream of partly solidified metal during operation of the installation. A curved roll rack receives the stream from the mold and defines a path in which the stream is guided from a substantially vertical toward a substantially horizontal direction of movement, the rack having two sections consecutively arranged along the path and having each a first terminal portion adjacent the first terminal portion of the other section, and a second portion remote from the other section, the section of the rack being supported on a support, and the mold being secured to the second terminal portion of one of the sections which is upwardly offset from the other section.

According to the invention, a pivot assembly secures each first terminal portion to the support for angular movement about a horizontal axis while a bearing is interposed between each of the second terminal portions and the support for sliding movement of the second portion relative to the support in a plane parallel to the associated horizontal axis.

Other features, additional objects, and many of the attendant advantages of this invention will readily be appreciated as the same becomes better understood by reference to the following detailed description of a preferred embodiment when considered in connection with the appended drawing whose sole FIGURE shows a continuous ingot casting installation according to the invention in fragmentary side elevation.

The drawing shows only as much of a otherwise conventional installation as is needed for an understanding of the invention.

A vertically open, water-cooled mold, its oscillating mechanism and supporting elements constitute a unit 1, not shown in detail since commonly known among workers in this art. Partly solidifed metal downwardly discharged from the mold unit 1 is received by a curved roll rack having two consecutive sections 2, 3. The upper section 2 is connected with the mold unit 1 for joint movement, as is known in itself. The lower section 3 continues the path of the metal stream from the originally vertical direction in the portion of the upper section 2 remote from the lower section 3 toward a horizontal direction where the lower rack portion 3 leads into a withdrawing rack 4. The rolls of the several rack sections, not specifically shown, define a median line 5 of the metal stream in the curved rack sections 2, 3. The line 5 is a continuous circular arc of radius R about a center of curvature 0 when the apparatus is inoperative and at ambient temperature. It merges smoothly with the median line 6 of the withdrawing rack 4.

The lower terminal portion of the rack section 2 rests on two brackets 7 fixedly mounted on integral parts of the support structure for the casting installation, only partly shown in the drawing. Only one of the two brackets 7, which are located on opposite sides of the rack portion 2 is visible in the drawing, and the two ends of a shaft 8, fixedly mounted on the rack portion 2, are journaled in the brackets respectively for pivotal movement of the rack section about a horizontal axis fixed relative to the support structure.

The upper terminal portion of the rack section 2 carries two slides 9 having each a planar bearing face opposite a corresponding bearing face of a bearing element 9' of the supporting structure. The two bearing faces shown in the drawing are spaced from each other, but they slidingly engage each other in all operative conditions of the installation for sliding movement along an interface indicated in the drawing by a arrow 11 passing through the axis of the shaft 8.

Another pair of slides 10 on the rack section 2 and bearing elements 10' of the supporting structure similarly engage each other in all operative conditions of the apparatus for sliding movement along an interface defined by an arrow 12 passing through the pivot axis of the shaft 8, the bearings 10, 10' being approximately centered between the shaft 8 and the bearing 9, 9'.

The upper terminal portion of the lower rack section 3 is similarly supported at its upper end, near the rack section 2, by two brackets 13 of the stationary supporting structure journaling a shaft 14 fixedly fastened to the rack section 3. Planar bearing faces on the portion of the rack section 3 remote from the section 2 normally slidably engage opposite faces of bearing elements 15 on the supporting structure, permitting movement of the lower terminal portion along an interface of the bearing components indicated by an arrow 16 through the pivot axis of the shaft 14.

The brackets 7, 13 are as closely spaced along the path of metal flow as thermal expansion of the apparatus permits. The drawing is not to scale, and the gap between the rack sections 2, 3 has been exaggerated for the convenience of pictorial representation.

When metal is poured into the roll rack from the mold unit 1, the sections 2, 3 expand, and the slides 9, 10 of the rack move on the associated bearing elements 9', 10' of the supporting structure in the direction indicated by the arrows 11, 12, 16. The dimensions of the rack sections and of their component parts are readily chosen on the basis of simple calculations so that the curved median line 5′ of metal flow in the rack sections 1, 2 at the normally intended operating temperature of the installation is circular about a center 0′ with a radius R′, and smoothly merges at a point 17 into a tangential median line 6′ of metal flow in the rack section 4, the point 17 being located vertically below the center of curvature 0′. The mold is moved by the expanding rack section 2 into position 1′ indicated in broken lines, and the tangential juncture 18 of the flow path through the cold mold 1 with the median line 5 is shifted to 18′ along a broken line in the drawing.

Within obvious limits set by the structure of the roll rack, the bearing faces on the rack and the supporting structure need not define interfaces in planes passing through the associated horizontal pivot axes, but the interfaces may be parallel to the associated axes but slightly offset from the axes in a radial direction. The plane of movement of each remote portion of the sections 2, 3 would still be parallel to the corresponding pivot axis.

Two sliding bearings have been shown associated with the upper rack portion 2 and only one associated with the lower rack portion 3. The number of sliding bearings may be increased to more than two or decreased to one for either section in a manner obvious from the illustrated embodiment.

It is generally more convenient to attach the shafts 8, 14 to the associated rack sections, and to journal them in bearings on the brackets 7, 13. Under suitable conditions, of course, the pivot shafts may be fixedly mounted on the supporting structure and rotatably support the rack sections.

It should be understood, therefore, that the foregoing disclosure relates only to a preferred embodiment of the invention, and that it is intended to cover all changes and modifications of the example of the invention herein chosen for the purpose of the disclosure which do not depart from the spirit and scope of the appended claims.

What is claimed is:

1. In a continuous casting installation including an oscillating mold adapted for downwardly discharging a stream of partly solidified metal during operation of the installation, and a curved roll rack mounted for receiving said stream from the mold and defining a path guiding the stream from a substantially vertical toward a substantially horizontal direction of movement, the rack having two sections consecutively arranged along said path and each having a first terminal portion adjacent the first terminal portion of the other section and a second terminal portion remote from the other section, said sections of said rack being supported on a support, and said mold being secured to the second terminal portion of one of said sections upwardly offset from the other section, the improvement which comprises:

1. pivot means securing each of said first terminal portions to said support for angular movement about a horizontal axis; and
2. bearing means interposed between each of said second terminal portions and said support for sliding movement of each second portion relative to said support in a plane parallel to the associated horizontal axis.

2. In an installation as set forth in claims 1, said path being substantially circularly arcuate, the respective axes of angular movement of said sections being closely juxtaposed and parallel.

3. In an installation as set forth in claim 2, said bearing means defining respective bearing faces on said support and on each of said sections, said bearing faces engaging each other in a interfacial plane, each of said horizontal axes being located in the associated interfacial plane when said roll rack is at a predetermined temperature.

* * * * *